United States Patent [19]

Bargiel

[11] 4,277,122

[45] Jul. 7, 1981

[54] CORNER FITTINGS

[75] Inventor: Stefan Bargiel, Liverpool, England

[73] Assignee: Newage Kitchens Limited, Liverpool, England

[21] Appl. No.: 83,611

[22] Filed: Oct. 11, 1979

[51] Int. Cl.[3] ..... A47B 88/00

[52] U.S. Cl. ..... 312/330 R; 312/140; 312/263

[58] Field of Search ..... 312/257 R, 263, 330, 312/108, 111, 140; 220/4 F, 76

[56] References Cited

U.S. PATENT DOCUMENTS

| | | | |
|---|---|---|---|
| 3,752,553 | 8/1973 | Bildahl et al. | 312/330 R |
| 4,120,551 | 10/1978 | Godtschalck | 312/330 R |
| 4,190,306 | 2/1980 | Litchfield et al. | 312/330 R |

*Primary Examiner*—Casmir A. Nunberg

*Attorney, Agent, or Firm*—Gipple & Hale

[57] ABSTRACT

The fitting is intended especially for forming the rear corners of a drawer and comprises at each end of the rear wall a hook formation extending therefrom in the plane of the rear wall. Each lateral wall's end portions is formed with an elongate opening through which the hook formation of the rear wall is entered. On the side remote from that from which the hook formation is entered through the opening, each lateral wall portion has an upstanding flange over which the claw or hook of the hook formation engages. On the opposite edge of the opening is a further upstanding flange towards which the other flange is slightly inclined to leave a gap less in width than the maximum thickness of the hook of a hook formation and at least one of the flanges is resilient so that when the hook seats over the edge of flange it is biassed to that position by the action of the flanges.

10 Claims, 1 Drawing Figure

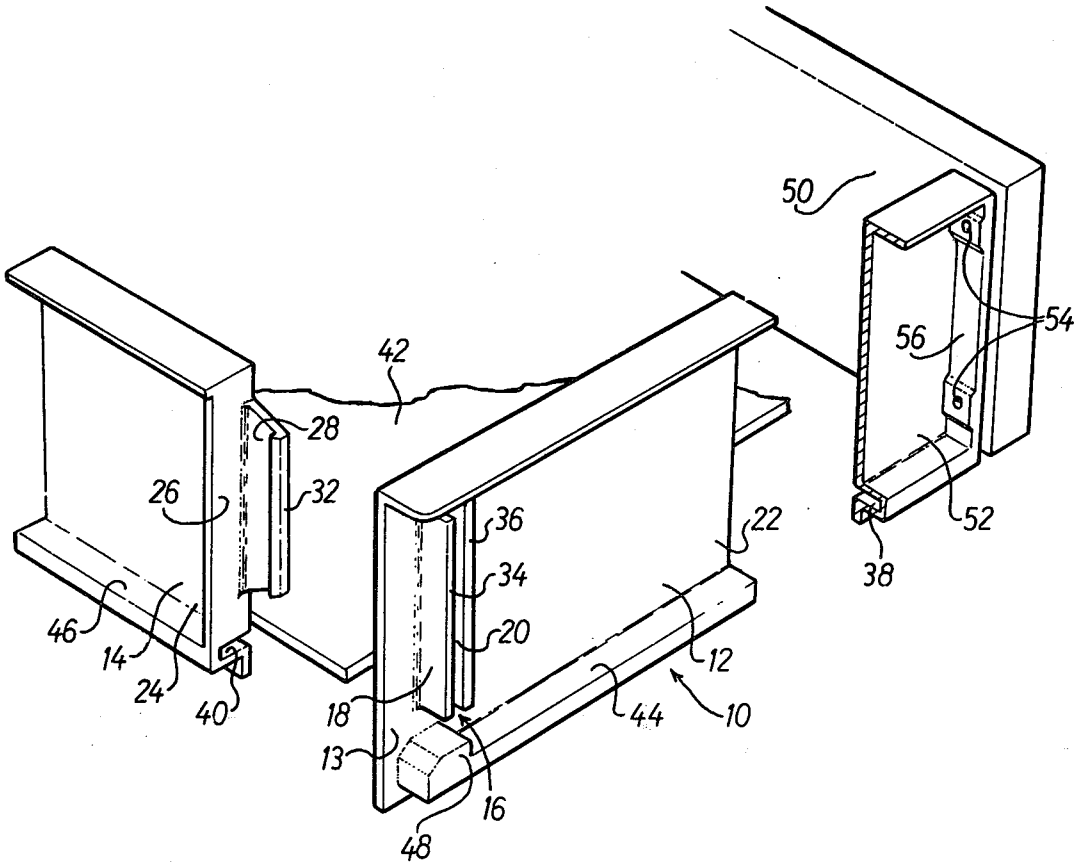
54
52
56
38
50
22
12
10
44
36
34
20
16
48
42
18
13
28
32
40
26
24
14
46

CORNER FITTINGS

DESCRIPTION

BACKGROUND OF THE PRIOR ART

The present invention relates to items of furniture such as drawers.

Hitherto, in the construction of items of furniture such as drawers adjacent walls or members were either joined together using joints such as dovetail joints, these joints being glued or pinned or both, or using brackets which were screwed or bolted to the walls or members and sometimes additionally glued.

Such construction techniques are disadvantageous in that the jointing of two walls or members e.g. of a drawer requires a considerable number of operations e.g. in cutting dovetail joints or drilling holes for the screws or bolts for a bracket. In addition, unless glued, such joints tend to work loose in time and as will be appreciated gluing the joints generally requires that the walls or members be clamped together until the glue has set, thus considerably increasing the assembly time.

Furthermore, such jointing techniques are generally applicable to jointing assembled furniture and are not suitable for kits intended to be assembled by the purchaser.

SUMMARY OF THE INVENTION

An object of the present invention is to provide a kit of parts for an item of furniture whose assembly avoids the aforementioned disadvantages.

Accordingly the present invention provides a kit of parts for an item of furniture, comprising two adjoinable parts having co-operable means inter-engageable in a snap-fitting manner to secure said two adjoinable parts in fixed relationship to one another, wherein the co-operable means comprises a barb-like member on one of said adjoinable parts and a throughgoing opening in the other adjoinable part; the latter being formed on one side thereof with an upstanding member partially bonding the opening as that, when the barb is inserted through the opening from the other side of said other adjoinable part, the upstanding member acts as a shoulder over which the barb-like member can be engaged in a snap-fitting manner; the other adjoinable member also being formed on said one side thereof with means for biasing said upstanding member and barb-like member, when thus engaged, against one another to maintain them in engagement.

Conveniently, said biassing means is an upstanding member on said one side of the other adjoinable part opposing said first-mentioned upstanding member and the minimum separation between the upstanding members is less than the maximum thickness of the barb-like member. At least one of the upstanding members and barb-like member is resiliently deformable to enable full engagement of the barb-like member through the opening.

In a preferred embodiment the kit of parts is for a drawer and comprises a base, two side walls, a rear wall and a front wall.

The advantage of the present invention lies in the simple snap-fitting manner in which the parts engage, pinning or gluing not being required.

BRIEF DESCRIPTION OF THE DRAWINGS

The present invention is further described hereinafter, by way of example, with reference to the accompanying drawing, which is an exploded view of a corner of a drawer in accordance with the present invention.

DETAILED DESCRIPTION OF THE DRAWINGS

The drawer 10 has two side walls 12 (only one of which is shown in part) respective end portions 13 of which are interconnected by a rear wall 14.

The end portion 13 of the side wall 12 shown in the drawing has a recess in the form of an elongate throughgoing opening 16 which extends transversely of the side wall 12, preferably at right angles to the longitudinal axis of the side wall 12. The longer side edges of the opening 16 are provided with respective upstanding members in the form of rectilinear flanges 18,20 on an outwardly facing major surface 22 of the side wall 12. The flange 20 projects preferably at right angles to the surface 22 while the flange 18 is preferably angled towards the flange 20 to narrow the opening 16 in a direction away from the surface 22.

Advantageously both flanges 18, 20 are resiliently deformable although only one of these need be resiliently deformable.

The end 24 of the rear wall 14 has a flange 26 upstanding from the plane of the wall 14 and which carries a barb-like member in the form of a tongue 28 which extends in the direction of the longitudinal axis of the rear wall and is formed with a hook 32 at its extremity. The hook is angled preferably at right angles to the plane of the tongue 28.

The flange 26 preferably lies at right angles to the plane of the rear wall 14 and to the longitudinal axis thereof, but can be omitted altogether.

When the rear wall 14 is assembled to the side wall 12 the tongue 28 is engaged into the opening 16. The minimum separation of the flanges 18 and 20 is less than the maximum thickness of the hook 32 so that as the hook 32 is pushed into the opening it forces the flanges apart. Once the hook 32 passes beyond the edges 34 and 36 of the flanges the latter spring back to their original positions and the edge 34 engages with and serves as a stop for the hook 32 to prevent the tongue 28 from being withdrawn through the opening 16. The right hand flange 20 serves to bias the tongue 28 against the left hand flange 18.

The length of the tongue 28 is preferably such that the flange 26 abuts securely against the side wall 12 without play when the edge 34 abuts against and serves as a stop for the hook portion 32.

The tongue 28 is preferably made of resiliently deformable material.

Each of the side walls 12 and the rear wall 14 has a respective channel 38,40 extending longitudinally thereof and formed adjacent a lower edge thereof. Each channel 38,40 opens inwardly of the drawer to engage the edges of a base 42 of the drawer.

The walls of each channel 38,40 are formed by respective ribs 44,46 which project outwardly of the drawer and conveniently serve as strengthening features of the associated walls.

The ribs 44 of the side walls 12 also serve as runners for the drawer and each rib has a shoulder 48 formed at its end adjacent the opening 16 which serves as a stop for the drawer to prevent the drawer from being pulled directly from its frame (not shown).

The channels 38 are closed at their ends adjacent the opening 16 whereas the channel 40 is open at both ends and, when the side and rear walls are assembled together, opens into the channels 38 so that the base 42 can be slid into the channels 38 and 40 from the front of the drawer.

The base is advantageously secured in position by a front wall 50 of the drawer which wall 50 is secured to the ends 52 of the side walls 12 by means of screws, bolts or clips (not shown) extending through holes 54 in upstanding flanges 56 of the walls 12.

The front wall conveniently has a channel (not shown) which accommodates a front edge of the base.

Alternatively the channels 38 are closed at both ends so that in assembling the drawer one side wall 12 and the rear wall 14 are interconnected, the base 42 is slid into place and is then secured by engagement of the other side wall 12 with the rear wall 14.

The orientation respectively of the tongue 28 and the opening 16 relative to the rear wall 14 and the side wall 12 is not critical as long as the rear wall 14 and the side wall 12 are held substantially at right angles to one another and to the base 42 when the drawer is assembled.

In a further embodiment (not shown) of a drawer in accordance with the present invention the openings 16 are formed in the rear wall and the hooks 32 are formed on the side walls.

In yet a further embodiment of a drawer in accordance with the present invention one or both flanges 18, 20 are strengthened by at least one gusset. Advantageously one or both flanges 18, 20 extend to a top edge of the wall 12.

Preferably one or more members of the drawer, i.e. the base, the side walls, the rear wall and the front wall, is made of plastic material, advantageously impact polystyrene, and conveniently by injection moulding.

In a still further embodiment of a drawer in accordance with the present invention the hook and the opening are formed in elements separate from the walls of the drawer and are secured thereto in respective cooperating position.

I claim:

1. A kit of parts for making up a drawer comprising a bottom wall, side walls, a front wall and a rear wall, the two side walls and the rear wall on their inner aspects being formed with a groove such that with the side walls joined to the rear wall, the bottom wall can be positioned in place by being slid in the grooves of the side walls until the rear edge of the bottom wall is received in the groove of the rear wall, said drawer walls being held rigidly together by cooperating means integrally formed as end portions of the rear wall as rear end portions of the side walls, and separately formed fastening means securing the front ends of the side walls to the front wall; said integrally formed cooperating means comprising in respect of each side wall rear end portion and respective rear wall end portion, a barb-like member on one of them and an elongated throughgoing opening on the other of them passing transversely thereof and with, on the exterior side of the other wall portion, an upstanding member partially bounding said opening so that when the barb is inserted through the elongate opening from the interior side of the other wall portion, the upstanding member acts as a shoulder over which the barb-like member can be engaged in a snap-fitting manner; and on the exterior of the other wall portion, means for biassing the barb-like member and the upstanding member when engaged against one another to maintain them in engagement.

2. A kit of parts as claimed in claim 1 wherein said biassing means is an upstanding member opposing said first-mentioned upstanding member on said one side of the other adjoinable part and the minimum separation between the upstanding members is less than the maximum thickness of the barb-like member; at least one of the upstanding and barb-like members being resiliently deformable to enable full engagement of the barb-like member through the opening.

3. A kit of parts as claimed in claim 1, wherein said barb-like member is a tongue formed with a hook at its extremity.

4. A kit of parts as claimed in claim 1 wherein said one wall portion is a rear wall end portion and the other wall portion is a side wall rear end portion.

5. A kit of parts as claimed in claim 1 wherein said bottom wall, side walls, front wall and rear wall are constructed of a plastic material.

6. A kit of parts as claimed in claim 1 wherein said plastic material is impact polystyrene.

7. A kit of parts for making up a drawer comprising a bottom wall, side walls, a front wall and a rear wall, the two side walls and the rear wall being provided with ribs which project outwardly from the outer wall surface, groove means formed in said ribs so that when the side walls are joined to the rear wall, the bottom wall can be positioned in place by sliding it into the grooves formed in the ribs with the rear edge of the bottom wall being received in the groove of the rear wall, said rear and side drawer walls being held securely together by cooperating means integrally formed as end portions of the rear wall and as end portions of the side walls, said front wall and said side drawer walls being held together by formed fastening means securing the front end of the side walls to the front wall, said integrally formed cooperating means comprising in combination a barb-like member extending from one of said walls, a throughgoing aperture defined by the other opposing wall aligned with said barb-like member and of sufficient size to allow the barb-like member to pass therethrough, an upstanding member partially bounding said aperture so that when the barb-like member is inserted through the aperture the upstanding member acts as a shoulder over which the barb-like member can be engaged in a snap-fitting manner; and means for biassing the barb-like member and the upstanding member when engaged against one another to maintain them in engagement.

8. A kit as claimed in claim 7 wherein said barb-like member is resilient.

9. A kit as claimed in claim 7 wherein said upstanding member is resilient.

10. A kit as claimed in claim 7 wherein said biassing means comprises a second upstanding member which is slightly angled toward said first upstanding member to narrow the aperture in a direction away from the surface.

* * * * *